US005179933A

United States Patent [19]

McCrillis et al.

[11] Patent Number: 5,179,933

[45] Date of Patent: Jan. 19, 1993

[54] SINGLE CHAMBER WOOD STOVE INCLUDING GASEOUS HYDROCARBON SUPPLY

[75] Inventors: Robert C. McCrillis, Durham; Nelson L. Butts, Hillsborough; Wade H. Ponder, Raleigh; James H. Abbott, Cary, all of N.C.

[73] Assignee: The United States of America as represented by the Administrator of the Environmental Protection Agency, Washington, D.C.

[21] Appl. No.: 788,899

[22] Filed: Nov. 7, 1991

[51] Int. Cl.[5] ..... F24C 1/14

[52] U.S. Cl. ..... 126/77; 110/212; 110/345; 422/182

[58] Field of Search ..... 126/77, 112, 58, 67, 126/80, 60, 64; 110/212, 211, 213, 345, 214; 422/172, 182, 183; 431/2, 10, 5

[56] References Cited

U.S. PATENT DOCUMENTS

| | | | |
|---|---|---|---|
| 4,078,541 | 3/1978 | Roycraft | 126/77 |
| 4,123,979 | 11/1978 | Tesch | 110/212 |
| 4,515,089 | 5/1985 | Ehrlichmann | 110/212 |
| 5,007,404 | 4/1991 | Hall et al. | 126/77 |

*Primary Examiner*—James C. Yeung

*Attorney, Agent, or Firm*—Lowe, Price, LeBlanc & Becker

[57] ABSTRACT

A single chamber wood stove has primary and secondary combustion zones in direct fluid flow communication with each other. Air from outside the stove is supplied to the primary and secondary combustion zones. Gaseous hydrocarbon fuel from a source located outside the stove is selectively supplied to the secondary combustion zone and is ignited by a glow plug in the secondary combustion zone in response to a signal derived by a temperature detector in the secondary zone. The gaseous hydrocarbon fuel flows to the secondary combustion zone at a rate in the range of about 0.25 to 3 cubic feet per hour. The fuel is supplied to the secondary zone when the secondary zone temperature is above carbon monoxide ignition temperature.

39 Claims, 4 Drawing Sheets

START
IS THERMOCOUPLE 48 TEMP > 1000° F ?
80
YES
NO
114
OPEN VALVE 30
OPEN VALVE 30
82
ENERGIZE GLOW/PLUG 46
84
START TIMER
86
88
READ AND STORE TEMP. OF THERMOCOUPLE 48 (A)
90
DELAY UNTIL TIMER TIMES/OUT AFTER 30-60 SECONDS
92
READ AND STORE TEMP. OF THERMOCOUPLE 48 (B)
94
(B-A)
96
IS (B-A) > 100°F ?
NO
YES
102
CLOSE VALVE 30
104
DE-ENERGIZE GLOW/PLUG 46
START 4 MIN. TIMER
115
TO FIG. 3B

SINGLE CHAMBER WOOD STOVE INCLUDING GASEOUS HYDROCARBON SUPPLY

TECHNICAL FIELD

The present invention relates generally to wood stoves and more particularly to a single chamber wood stove having primary and secondary combustion zones in direct fluid flow communication with each other and wherein gaseous hydrocarbon fuel is supplied to and ignited in the secondary combustion zone in response to the temperature in the secondary zone having a determined value.

BACKGROUND ART

Residential wood stoves are essentially closed, semi-sealed boxes where wood is burned. The wood is in large chunks which burn only on the surface thereof. However, the entire wood chunk becomes heated, leading to fractional distillation of organic compounds from the wood chunk interior. The organic compounds are released into a combustion chamber of the stove where the wood is located. The organic compounds are not completely burned and are discharged as air pollutants from a chimney connected to the stove.

Air enters the stove through a controlled opening, while smoke and combustion products leave through a second, uncontrolled opening and flow to the chimney. The burn rate of wood fuel is regulated by controlling the rate air enters the stove. The domestic wood stove is frequently operated in an air-choked mode at low burn rates, in the range of 1 kilogram per hour, resulting in high particulate, carbon monoxide and hydrocarbon emissions. At such low burn rates, the wood temperature is too low to ignite and burn the particulate, carbon monoxide and hydrocarbon emissions, causing these products of combustion to add to pollution.

Hence, a serious problem with wood stoves as domestic heating sources is the pollutants produced thereby as a result of incomplete combustion of the burning wood. The incomplete combustion causes excessively high particulate, carbon monoxide and hydrocarbon emissions.

In one prior art single chamber wood stove having primary and secondary combustion zones in direct communication with each other, i.e., where no baffle or wall is between the primary and secondary combustion zones, particulate emissions were measured at 25.4 grams per hour, carbon monoxide emissions at 126.3 grams per hour, and hydrocarbon emissions of 17.7 grams per hour. These data were collected while burning seasoned oak cordwood, with airflow settings from outside the wood stove to the primary and secondary combustion chambers set at minimum values therefor.

We have found through measurements that wood stoves having separate primary and secondary combustion chambers, i.e., chambers separated from each other by a baffle or wall, wherein wood is burned in the primary chamber, do not resolve the incomplete combustion problem or are very inefficient. Gases flowing from the primary combustion chamber to the secondary combustion chamber are cooled to such an extent that the particulates, carbon monoxide and hydrocarbons are not burned in the secondary combustion chamber. Measurements we have conducted on the commonly assigned U.S. Pat. No. 5,007,404, wherein gases in the secondary combustion chamber are ignited, have demonstrated that high particulate, carbon monoxide, and hydrocarbon emissions are still present.

A wood stove including separate primary and secondary combustion chambers, arranged so that the secondary combustion chamber is supplied with a hydrocarbon fuel (e.g., methane, propane or butane) from an external source is reported on pages 40, 49 and 51 of EPA Report 600/7-81-091. The gaseous hydrocarbon fuel is stated to be ignited by an afterburner in the secondary combustion chamber. Flue gas in the secondary combustion chamber is reported as having sufficient air to burn the fuel and combustible emissions in the secondary combustion chamber.

While this prior art arrangement produces a significant reduction in hydrocarbon emissions, the prior art two chamber stove has been basically converted from a wood stove to a gas furnace. This is because the flow rate of the gaseous hydrocarbon fuel is reported as being from 2 to 3 cubic feet per minute. The 2 to 3 cubic feet per minute flow rates are comparable to the flow rates of domestic natural gas furnaces. Hence, the device and method of operation disclosed in this prior art report are not satisfactory for actual domestic applications, wherein wood stove owners are attempting to minimize expenses and the use of fuel sources other than wood.

It is, accordingly, an object of the present invention to provide a new and improved efficient wood stove having low particulate, carbon monoxide and hydrocarbon emissions.

Another object of the invention is to provide a new and improved single chamber wood stove having relatively low particulate, carbon monoxide and hydrocarbon emissions by providing almost complete combustion of gases released from the burning wood.

THE INVENTION

In accordance with one aspect of the invention, a single chamber wood stove having primary and secondary combustion zones in direct fluid flow communication with each other includes a source of gaseous hydrocarbon fuel located outside the stove and means responsive to the presence and absence of ignited gases in the secondary combustion zone for controlling the flow of the fuel to the secondary combustion zone. Air is supplied from outside the stove to the primary and secondary combustion zones.

Preferably, an ignitor in the secondary zone is controlled by the controlling means in response to the presence and absence of ignited gases in the secondary combustion zone.

In the preferred embodiment, hydrocarbon fuel is supplied to the secondary combustion zone at a rate in the range of about 0.25 to 3 cubic feet per hour, about the same rate as the flow to a pilot burner of a natural gas furnace.

The stove is operated by detecting if the temperature where the gaseous fuel is supplied to the secondary combustion zone is above a first determined temperature at which carbon monoxide ignites. In response to the detected temperature being above the determined temperature the gaseous fuel is continuously supplied to the secondary combustion zone until the detected temperature drops to a second determined temperature less than the first determined temperature. In response to the detected temperature dropping to or below the second determined temperature, the fuel supplied to the secondary combustion zone is ignited by energizing an ignitor in the secondary combustion zone. Hence a dead band is established to prevent continuous recycling of the ignitor between on and off states around a single temperature value. The ignitor is maintained in an energized condition until the detected temperature is above the first determined temperature.

As a safety measure, a determination is made as to whether the ignitor ignited the fuel a short time after energization of the ignitor. The ignitor is maintained in an energized condition until the detected temperature is above the first determined temperature. If fuel ignition is not detected the supply of the fuel to the secondary chamber is stopped.

In accordance with a further aspect of the invention, a wood stove adapted to be responsive to fuel from a gaseous hydrocarbon fuel source outside of the stove comprises a single chamber having a primary combustion zone and a secondary combustion zone in direct fluid flow relation with each other. An inlet through a wall of the stove admits air from outside the stove into the primary combustion zone where wood is loaded and burned. A manifold admits air from outside the stove into the secondary combustion zone. A conduit adapted to be connected to the fuel source supplies gaseous fuel from the fuel source to the secondary combustion zone. A flow controller for the gaseous fuel controller is in the conduit. A means detects the presence and absence of ignition of the gaseous fuel flowing from the conduit into the secondary zone, preferably by monitoring the gaseous fuel temperature. Means responsive to the ignition detecting means energizes the flow controller to on and off conditions. Preferably an ignitor in the secondary zone is positioned to selectively ignite the gaseous fuel flowing into the secondary zone from the conduit in response to the temperature sensing means.

The above and still further objects, features and advantages of the present invention will become apparent upon consideration of the following detailed description of several specific embodiments thereof, especially when taken in conjunction with the accompanying drawings.

DETAILED DESCRIPTION OF THE DRAWING

Figure 1:
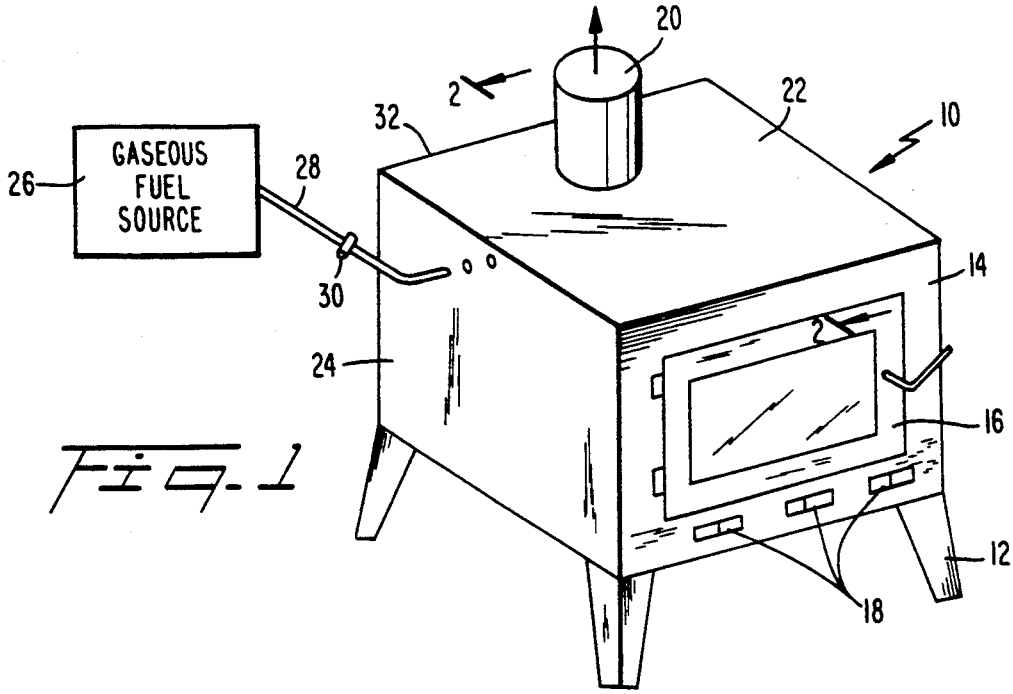
FIG. 1 is a perspective view of a wood stove including the present invention.
Figure 2:
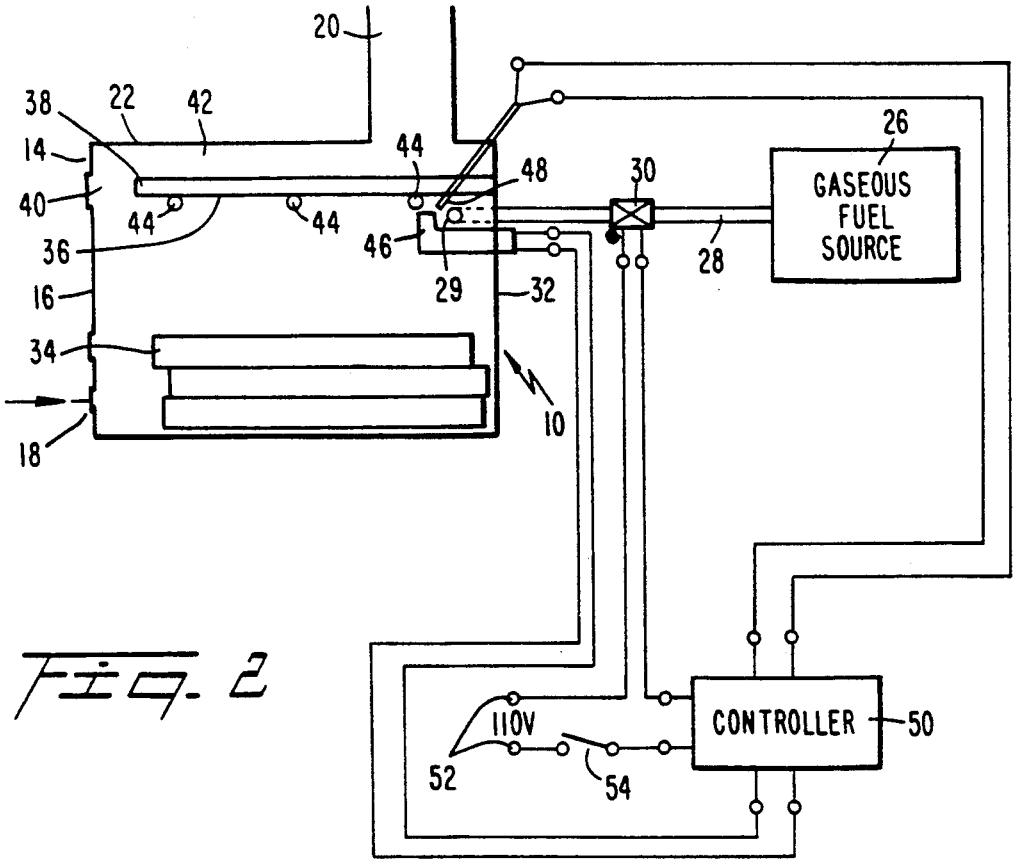
FIG. 2 is a side schematic diagram of the wood stove illustrated in FIG. 1, taken along lines 2—2, incorporating a microprocessor based temperature responsive embodiment of the present invention.

Reference is now made to FIGS. 1 and 2 of the drawing wherein wood stove 10 is illustrated as a right parallelepiped having metal exterior walls, a metal roof 22 and a metal floor sitting on legs 12. On front wall 14 of wood stove 10 is located wood access door 16, below which is one or more of air inlet openings 18, having variable area for adjusting the flow rate of outside air supplied to the stove interior. Flue gases resulting from burning of wood in stove 10 flow to a chimney by way of stovepipe 20, in fluid flow relation with the interior of stove 10 via a hole in roof 22. Hydrocarbon gaseous fuel, such as natural gas, liquid petroleum gas, or butane, is supplied from source 26 to the interior of stove 10, in the region between the top of door 16 and roof 22 through sidewall 24; source 26 is located outside of the stove. The gaseous hydrocarbon fuel flows from source 26 through pipe, i.e., conduit, 28, having valve 30 located therein. Air is supplied to the interior of stove 10 from outside the stove by way of an opening in stove back wall 31. The air flowing through back wall 31 opening flows into the stove interior in the region between roof 22 and the top of door 16.

As illustrated in FIG. 2, the interior of wood stove 10 is a single chamber including primary combustion zone 32 where wood fuel 34 is burning. Air passing through openings 18 is heated by the wood fuel as it flows from front wall 14 across the burning wood fuel to the vicinity of back wall 32, thence into secondary combustion zone 36. Primary combustion zone 32 is in direct fluid flow communication with secondary combustion zone 36 so that gases from zone 32 flow directly to zone 36, without the intermediary of a baffle or wall. Zone 36 is positioned immediately above zone 32 and directly below baffle plate 38 which extends horizontally from the stove sidewalls and back wall about 80 percent of the way across the stove from back wall 31 to front wall 14. Gap 40 is thereby provided in proximity to front wall 14 for gases flowing out of secondary combustion zone 36 into volume 42 between baffle 38 and roof 22, to flue pipe 20.

In secondary combustion zone 36 are pipes 44 extending between sidewall 24 and its opposing sidewall. Each of pipes 44 is connected by a manifold pipe (not shown) to air from outside of stove 10; alternatively, each of pipes 44 extends through an individual opening in sidewall 24 to be supplied with air from outside the wood stove. Each of pipes 44 is fixedly attached to a bottom face of baffle plate 38 and includes numerous openings (not shown) whereby air flowing through the pipes is heated by heat in zone 36 conducted through the pipe walls and flows through the holes into zone 36. The openings are along the lengths of each of the pipes 44 and disposed about the circumference of each pipe so that air is supplied in all directions to secondary combustion zone 36 between the stove opposed sidewalls.

Wood stove 10, as previously described, is a currently available, prior art wood stove, except for the inclusion of hydrocarbon gaseous fuel source 26, pipe 28 and valve 30.

Pipe 28, a main burner for hydrocarbon gaseous fuel from source 26, enters sidewall 24 and, prior to reaching the pipe 44 in closest proximity to back wall 31, has a right angle bend. Thereby pipe 28 extends parallel to back wall 31, slightly below pipes 44, in secondary combustion zone 36. Pipe 28 has a substantial extent parallel to pipes 44, between front wall 14 and back wall 32. Holes 29 are provided on the side of pipe 28 inside stove 10 facing pipes 44; hence holes 29 are along the portion of pipe 28 that extends parallel to back wall 32 to permit hydrocarbon fuel in pipe 28 to escape into secondary combustion zone 36. Glow plug 46, an ignitor for hydrocarbon gaseous fuel escaping from holes 29 in pipe 28, is positioned in proximity to some of these holes. Thermocouple 48 monitors the temperature in secondary combustion zone 36 in proximity to glow plug 46 and the holes in pipe 28. Thermocouple 48 supplies a DC voltage indicative of the temperature in proximity to glow plug 46 to controller 50, which derives output signals for controlling valve 30 and glow plug 46.

Controller 50 is connected to 110 volt AC terminals 52 by manually-controlled pushbutton switch 54. Control of current to valve 30 is by way of a switch (not shown) included in controller 50, as well as via contact 54 so that valve 30 is energized by AC current from terminals 52.

Controller 50 includes a conventional microprocessor, programmed to execute a sequence of operations for control of valve 30 and glow plug 46. To these ends, the microprocessor responds to thermocouple 48 to determine the temperature in zone 36 and performs operations to detect if the hydrocarbon fuel escaping through holes 29 in pipe 28 into zone 36 has been ignited.

Figure 3A:
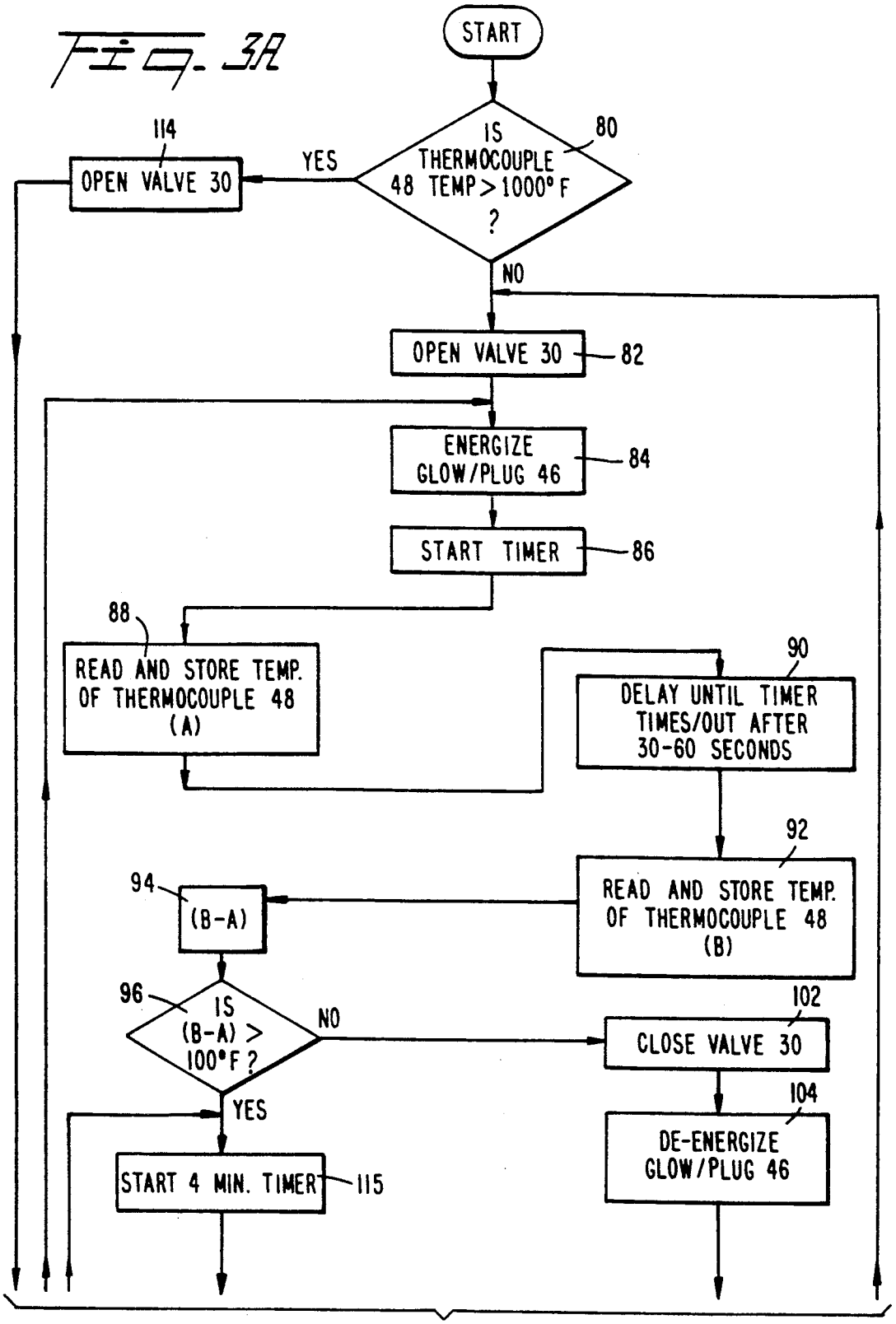
FIGS. 3A and B are flow diagrams of a controller employed in the wood stove illustrated in FIG. 2.
Figure 3B:
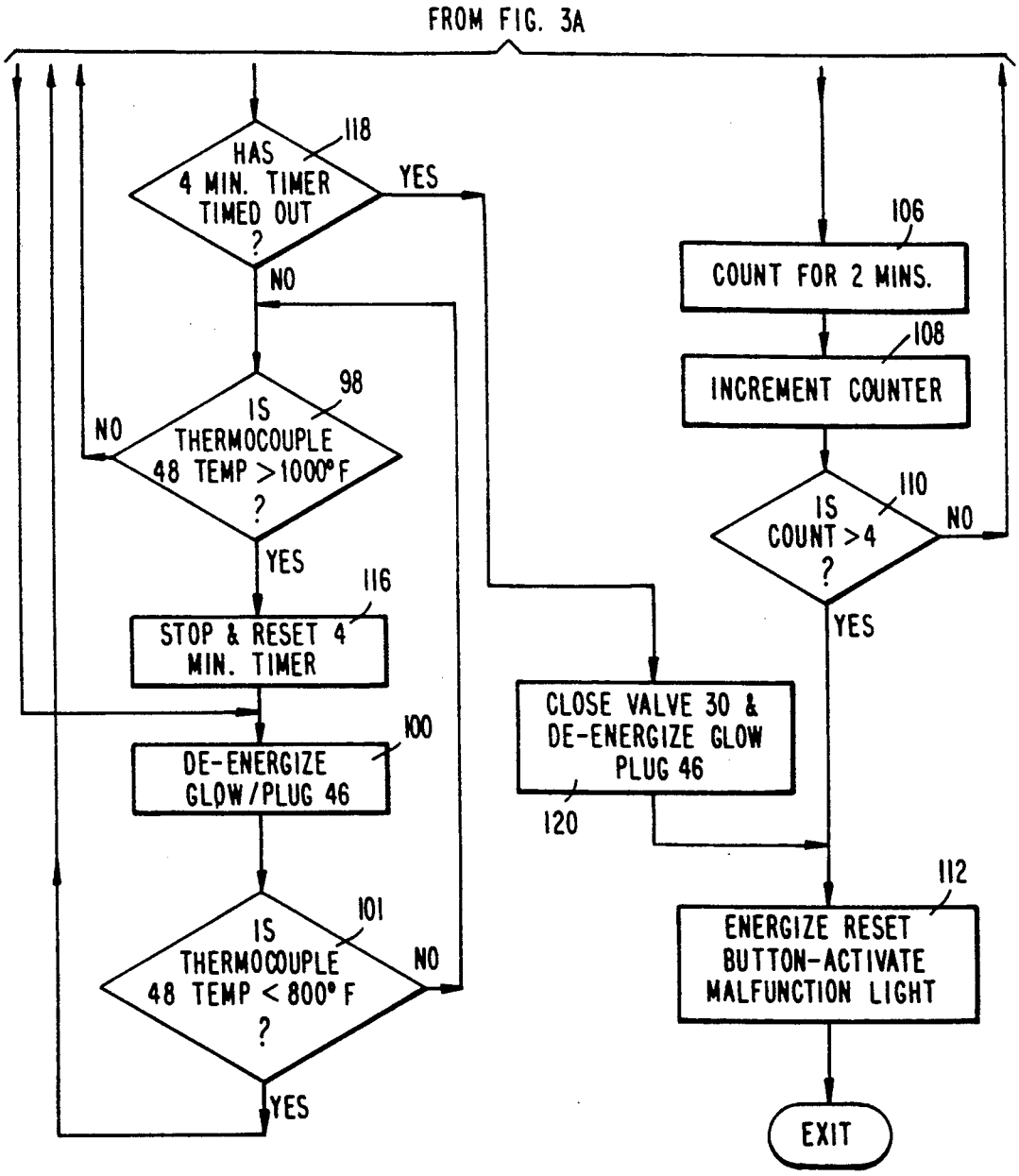

In operation, switch 54 is closed shortly after a fire has been started by igniting the wood in primary combustion zone 32. In response to closure of switch 54, the microprocessor in controller 50 is energized and the microprocessor executes a series of control operations, i.e., program steps, indicated by the flow chart of FIGS. 3A and B.

The first operation performed by microprocessor 80 is to determine if the temperature monitored by thermocouple 48 is in excess of the temperature necessary to ignite carbon monoxide gases in secondary combustion zone 36, typically approximately 1000° F. In response to the temperature monitored by thermocouple 48 being less than 1000° F., as detected during operation 80, controller 50 supplies signals to valve 30 and glow plug 46, to open the valve and energize the glow plug (operations 82 and 84), so that gas from source 26 flows through openings 29 in pipe 28 in secondary combustion zone 36, to be ignited by the glow plug.

A test is then made to ascertain if the gas coupled by pipe 28 into zone 36 has, in fact, been ignited by glow plug 46. Such a test is made by determining if the temperature detected by thermocouple 48 has increased by at least a predetermined amount within a predetermined time interval; a typical value for the minimum temperature increase is 100° F. while typical time intervals are in the 30 to 60-second range.

The test is made by starting a timer in the microprocessor (operation 86) and by reading and storing the temperature detected by thermocouple 48 when the timer is started (operation 88). After a predetermined delay interval, e.g., 30–60 seconds, the timer has timed out and is stopped (operation 90), immediately after which the temperature detected by thermocouple 48 is read and stored (operation 92). The initial and final stored temperatures are subtractively combined (operation 94) to determine the temperature increase in zone 36 over the predetermined interval. In operation 96 a test is made as to whether the temperature increase over the interval exceeds 100° F. to determine if ignition occurred.

If ignition is detected, controller 50 continues to supply energization signals to maintain valve 30 open and to activate glow plug 46. Valve 30 remains open during continued operation of the wood stove, to deliver hydrocarbon gaseous fuel from source 26 to pipe 28 at a rate in the range of 0.25 to 2 cubic feet per hour, while the temperature detected by thermocouple 48 is continuously monitored by the microprocessor. Glow plug 46 remains energized until the temperature detected by thermocouple 48 reaches a predetermined value, e.g., 1000° F. (operation 98), at which time the glow plug is de-energized (operation 100). As long as the temperature in zone 36 remains above 1000° F., or a deadband slightly less than the 1000° F. level, such as down to 600° F., the temperature in zone 36 is adequate to ignite the gas flowing out of holes 29 in pipe 28.

If, however, it is found during operation 96 that the gas supplied by holes 29 to zone 36 is not ignited by glow plug 46 (because the temperature detected by thermocouple 48 did not increase by 100° F. within the prescribed 30 to 60-second interval), controller 50 closes valve 30 and de-energizes glow plug 46 (operations 102 and 104, respectively). Valve 30 and glow plug 46 remain in closed and de-energized conditions for a sufficient time interval to prevent possible explosion of gas in secondary combustion chamber; a typical period of de-energization is two minutes. After the two-minute interval has expired (operation 106), the program increments a counter (operation 108) in the microprocessor and then returns to operations 82 and 84 if operation 110 indicates a count greater than four has not been reached. Operations 82 and 84 cause controller 50 to re-open valve 30 and re-energize glow plug 46.

A test is again made, as described supra in connection with operations 86, 88, 90, 92, 94 and 96, to determine if the gas escaping through holes 29 has been ignited. This sequence of operations is repeated four times if the required temperature increase within the predetermined time interval is not detected during operation 96. If four tests to determine ignition reveal that ignition has not occurred, as determined by operation 110, the program advances to operation 112, causing controller 50 to energize a reset button and activate a malfunction light. If the reset button and malfunction light are energized, the program is exited whereby valve 30 cannot be opened and glow plug 46 cannot be energized until switch 54 is opened and then closed and the reset button has been tripped.

As indicated sucra, during normal operation, which occurs in response to the temperature monitored by thermocouple 48 being in excess of 1000° F. (as indicated by operations 80 and 98), controller 50 maintains valve 30 in an open condition and glow plug 46 is de-energized (operation 100). In response to a "YES" from operation 80, open valve 30 operation 114 is executed if the valve had not been previously opened. If, after normal steady state operation has been established, i.e., upon completion of operation 100, a test is made during operation 101 to determine if the temperature detected by thermocouple 48 is below the 600° F. deadband lower limit. If operation 101 produces a "YES," the program returns to operation 84 and glow plug 46 is again energized to ignite the gas flowing through holes 29 and valve 30 is maintained in an open condition. Tests are again made to determine if the hydrocarbon fuel escaping from holes or ports 29 was ignited by executing operations 88, 90, 92, 94 and 96 performing operations 102, 104, 106, 108, 110 and 112 or 98 and 100, as appropriate.

If operation 101 indicates thermocouple temperature is above 600° F., the program returns to operation 98 and recycles between operations 98 and 101 as long as temperature is above 1000° F.

As a safety precaution, if normal operation (indicated by a "YES" from operation 98) does not occur within a predetermined time, e.g., four minutes, from initial derivation of a "YES" from operation 96 or a "NO" from operation 98, valve 30 is closed, glow plug 46 is de-energized, energize reset button and activate malfunction light operation 112 is performed and the program is exited. To these ends, during operation 115, a counter of the microprocessor is started in response to the leading edge of a "YES" output from operation 96 or the leading edge of a "NO" output of operation 98. In response to a "YES" being derived from operation 98, the counter started during operation 115 is stopped during operation 116. If the counter started during operation 115 reaches a count associated with four minutes, as detected during operation 118, valve 30 is closed and glow plug 46 is de-energized during operation 120, followed by operation 112.

Tests with and without gaseous hydrocarbon fuel on the wood stove illustrated in FIGS. 1 and 2 indicate significant improvements in emitted particulates and carbon monoxide emissions. The tests were conducted with the same conditions, e.g. same wood type and same air flow settings on the same stove illustrated in FIGS. 1 and 2. Valve 30 was permanently opened and closed in different tests; when valve 30 was opened, gaseous hydrocarbon fuel flowed at a rate of 2 cubic feet per hour into the secondary combustion zone (as described). The tests indicate particulate emissions were reduced from about 25.4 grams per hour (without the gaseous fuel) to about 0.1 to 0.2 grams per hour, carbon monoxide emissions were reduced from 126.3 grams per hour (without the gaseous fuel) to about 40 to 60 grams per hour, and hydrocarbon emissions were reduced from about 17.7 grams per hour (without the gaseous fuel) to about 4.1 grams per hour.

Figure 4:
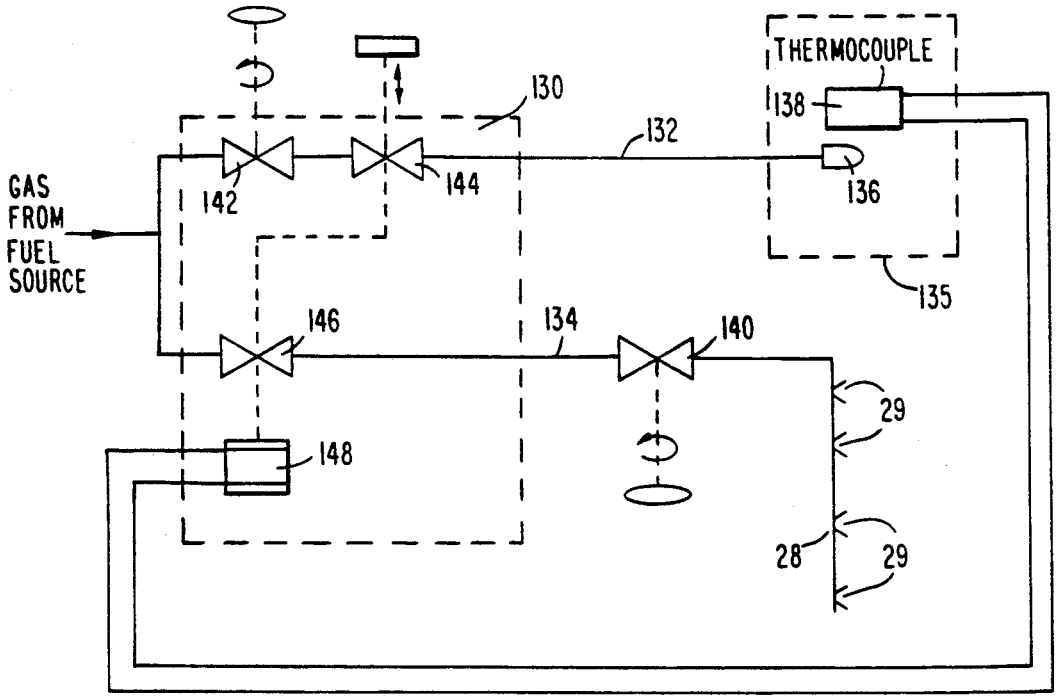
FIG. 4 is a schematic diagram of an alternative temperature responsive controller included in the invention.

Reference is now made to FIG. 4 of the drawing wherein microprocessor-based controller 50 of FIG. 2 is replaced by a manually-controlled system including conventional safety valve envelope 130, conduits 132, 134, conventional multi-mount assembly 135 including pilot burner tube 136, thermocouple 138, and manually-activated valve 140. Safety valve envelope 130 includes rotatably-driven, manually-activated valve 142 in series with manually-activated spring-biased push button valve 144, and solenoid-responsive valve 146 driven by solenoid 148, also mechanically coupled to valve 144. Valves 142 and 144 are connected between fuel source 26 and conduit 132, in turn connected to pilot burner tube 136. Thermocouple 138, positioned in immediate proximity to pilot burner tube 136, generates a voltage indicative of the temperature of the gas at the pilot burner tube. The voltage generated by thermocouple 138 is supplied to solenoid 148 so when the detected temperature exceeds a predetermined value, the solenoid closes valve 148, connected in series with valve 140 by conduit 134 to control the flow of fuel from source 26 to the main burner comprising holes 29 in tube 28.

Valve envelope 130 and valve 140 are mounted close to each other on a region of the exterior of stove 10 not subject to excessive heat. Multi-mount assembly 135 and main burner tube 28 are in secondary combustion zone 36. Thermocouple 138 includes hot and cold junctions attached to a mounting bracket. Thermocouple 138 is constructed and arranged so the hot junction is in the flame from pilot burner tube 136 while the cold junction is displaced from the flame. When the pilot from tube 136 is lit the resulting temperature difference between the hot and cold junctions causes a voltage proportional to the temperature difference to be generated. Solenoid 148 is designed so valve 146 is held open in response to the hot junction temperature exceeding the cold junction temperature by 300° F. When the difference between the hot and cold junction temperatures is less than 300° F., valves 144 and 146 are closed to prevent fuel flowing from source 26 to tubes 28 and 136.

Operation is as follows, assuming stove 10 is cold and no flame is obtained from pilot or main tubes 136 and 28:

1) Open manual, rotatable gas valve 142 on safety valve assembly 130;

2) Close manual valve 140 in gas line 134 to main burner tube 28;

3) Hold a lit match at the tip of pilot burner tube 136 and depress the button on safety valve 144 so gas flows from source 26 to pilot tube 136. If the pilot lights, continue to keep the button for valve 144 depressed for one minute. Release the button after one minute. Fuel from source 26 is at this time supplied to pilot burner tube 136 without flowing to main burner tube 28 because valve 140 is maintained closed while valve 144 is opened in response to the 300° F. temperature difference detected by thermocouple 138. If the fuel flowing to tube 136 is not lit, repeat from step 1; if the fuel is lit, proceed to step 4;

4) Build a wood fire in stove 10 following normal operating procedure. Once the wood fire is lit, open main burner tube gas valve 140. Fuel thereby flows at a rate of about 0.25 to 3 cubic feet per hour from source 26 to main burner tube 28, thence through holes 29 and is ignited by the flame from pilot tube 136. The ignited fuel flowing through holes 29 is combined with gas from the burning logs and air flowing through holes in pipes 44 to provide relatively complete combustion of the gas from the burning logs. Hence, high efficiency and low pollutant emissions are provided;

(5) When the wood fire has burned out, close main burner tube gas valve 140. It is not necessary to shut off valve 142. If stove 10 is not going to be used for several days, valve 142 can be shut off to conserve fuel.

Figure 5:
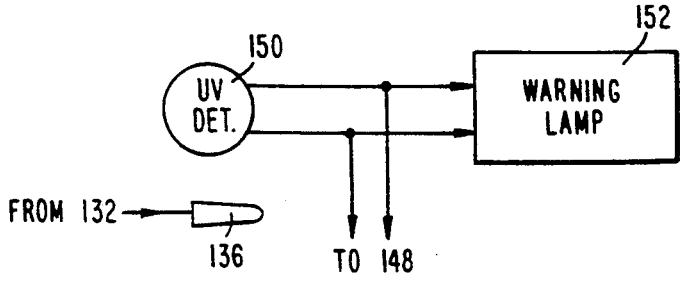
FIG. 5 is a schematic diagram of a portion of an ultraviolet responsive controller included in the invention.

In accordance with a further aspect of the invention, thermocouple 138 is replaced with ultraviolet detector 150, FIG. 5, in the field of view of the flame from pilot burner tube 136. Detector 150 derives an output voltage having increasing amplitudes for increasing intensity of the flame from tube 136 so that the amplitude of the voltage from detector 150 corresponds with the amplitude of the voltage generated by thermocouple 138. The output voltage of detector 150 is applied to solenoid 148 in the manner the thermocouple voltage is applied to the solenoid in FIG. 4. The apparatus of FIG. 5 is thus used with a system in a manner identical to that illustrated in FIG. 4. If, however, the pilot flame from tube 136 is extinguished, warning lamp 152 is energized in response to the low amplitude output of detector 150.

While there have been described and illustrated several specific embodiments of the invention, it will be clear that variations in the details of the embodiment specifically illustrated and described may be made without departing from the true spirit and scope of the invention as defined in the appended claims.

We claim:

1. In combination, a single combustion chamber wood stove having primary and secondary combustion zones therein in direct fluid flow communication with each other, means for supplying air to the primary and secondary combustion zones, a source of gaseous hydrocarbon fuel located outside the stove, and means responsive to the presence and absence of ignited gases in the secondary combustion zone for controlling the flow of the gaseous hydrocarbon fuel to the secondary combustion zone, the wood stove single combustion chamber being arranged so the gaseous hydrocarbon fuel in the secondary zone and wood in the single chamber both burn in the single chamber, the gaseous hydrocarbon fuel being introduced into the secondary combustion zone in such a manner as to ignite unburned combustible gases leaving the wood being burned in the primary zone.

2. The combination of claim 1 further including an ignitor in the secondary zone controlled by said controlling means in response to the presence and absence of ignited gases in the secondary combustion zone.

3. The combination of claim 2 wherein the controlling means includes means for deriving an indication of the temperature of gases in the secondary combustion zone to perform the following operations:

(a) detecting if the temperature where the gaseous fuel is supplied to the secondary combustion zone is above a first determined temperature at which CO ignites, (b) in response to the detected temperature being above the determined temperature continuously supplying the gaseous fuel to the secondary combustion until the detected temperature drops to a second determined temperature less than the first determined temperature, (c) in response to the detected temperature dropping to or below the second determined temperature, igniting the fuel supplied to the secondary combustion zone by energizing an ignitor in the secondary combustion zone.

4. The combination of claim 3 wherein the controlling means is arranged to maintain the ignitor in an energized condition until the detected temperature is above the first determined temperature.

5. The combination of claim 3 wherein the controlling means is arranged to (i) detect if the fuel was ignited by the ignitor being energized a short time after energization of the ignitor and (ii) maintain the ignitor in an energized condition until the detected temperature is above the first determined temperature in response to operation (i) detecting fuel ignition.

6. The combination of claim 3 wherein the controlling means is arranged to (i) detect if the fuel was ignited by the ignitor being energized a short time after energization of the ignitor, (ii) maintain the ignitor in an energized condition until the detected temperature is above the first determined temperature in response to operation (i) detecting fuel ignition, and (iii) stop the supply of the fuel to the secondary chamber in response to operation (i) not detecting fuel ignition.

7. The combination of claim 6 wherein the controlling means is arranged to repeat operations (i), (ii) and (iii) subsequent to operation (i) not detecting fuel ignition.

8. The combination of claim 6 wherein the controlling means is arranged to repeat operations (i), (ii) and (iii) only a predetermined number of times subsequent to operation (i) not detecting fuel ignition.

9. The combination of claim 1 wherein the secondary combination zone includes pilot and main burners respectively connected by separate first and second conduits to the fuel source, means for detecting the presence and absence of ignited gases in proximity to the pilot burner, means for controlling the flow of the fuel in the first conduit to the pilot burner, and means responsive to the detecting means for controlling the flow of the fuel in the second conduit to the main burner.

10. The combination of claim 9 wherein the first conduit control means includes a manually controlled valve in the first conduit.

11. The combination of claim 9 wherein the detecting means includes a thermocouple in proximity to the pilot burner for sensing the temperature of gas in proximity to the pilot burner, the thermocouple causing the second conduit control means to enable the fuel to flow from the fuel source to the main burner in response to the sensed temperature exceeding a predetermined value.

12. The combination of claim 1 wherein the means for controlling causes the gaseous fuel to flow into the secondary zone at a rate comparable to the flow rate of gas to a pilot burner of a natural gas furnace.

13. The combination of claim 1 wherein the primary and secondary zones are respectively at the bottom and top portions of the chamber.

14. A method of controlling a wood stove having a single combustion chamber including a primary combustion zone and a secondary combustion zone in direct fluid flow relation with the primary combustion zone comprising igniting a gaseous hydrocarbon fuel supplied from a source outside the stove to the secondary combustion zone while (a) air is supplied to the secondary combustion zone, (b) wood is burning in the primary combustion zone, (c) air from outside the stove is supplied to the primary combustion zone and (d) products of combustion from the wood burning in the primary zone flow directly to the secondary zone so that combustible gas in the secondary zone from the burning wood is ignited by the ignited gaseous fuel.

15. The method of claim 14 wherein the gaseous hydrocarbon fuel is supplied to the secondary combustion zone at a rate in the range of about 0.25 to 3 cubic feet per hour.

16. The method of claim 15 wherein the air is supplied to the secondary combustion zone from outside the stove.

17. The method of claim 15 further comprising detecting if the temperature where the gaseous fuel is supplied to the secondary combustion zone is above a first determined temperature at which CO ignites, in response to the detected temperature being above the determined temperature continuously supplying the gaseous fuel to the secondary combustion until the detected temperature drops to a second determined temperature less than the first determined temperature, and in response to the detected temperature dropping to or below the second determined temperature igniting the fuel supplied to the secondary combustion zone by energizing an ignitor in the secondary combustion zone.

18. The method of claim 17 further comprising maintaining the ignitor in an energized condition until the detected temperature is above the first determined temperature.

19. The method of claim 17 further comprising (i) detecting if the fuel was ignited by the ignitor being energized a short time after energization of the ignitor and (ii) maintaining the ignitor in an energized condition until the detected temperature is above the first determined temperature in response to detecting step (i) detecting fuel ignition.

20. The method of claim 19 wherein the first and second determined temperatures are respectively above 1000° F. and 600° F.

21. The method of claim 17 further comprising (i) detecting if the fuel was ignited by the ignitor being energized a short time after energization of the ignitor and (ii) maintaining the ignitor in an energized condition until the detected temperature is above the first determined temperature in response to detecting step (i) detecting fuel ignition.

22. The method of claim 17 further comprising (i) detecting if the fuel was ignited by the ignitor being energized a short time after energization of the ignitor, (ii) maintaining the ignitor in an energized condition until the detected temperature is above the first determined temperature in response to detecting step (i) detecting fuel ignition, and (iii) stopping the supply of the fuel to the secondary chamber in response to detecting step (i) not detecting fuel ignition.

23. The method of claim 22 further comprising repeating steps (i), (ii) and (iii) subsequent to step (i) not detecting fuel ignition.

24. The method of claim 22 further comprising repeating steps (i), (ii) and (iii) only a predetermined number of times subsequent to step (i) not detecting fuel ignition.

25. The method of claim 14 further comprising detecting if the temperature where the gaseous fuel is supplied to the secondary combustion zone is above a first determined temperature at which CO ignites, in response to the detected temperature being above the determined temperature continuously supplying the gaseous fuel to the secondary combustion until the detected temperature drops to a second determined temperature less than the first determined temperature, in response to the detected temperature dropping to or below the second determined temperature igniting the fuel supplied to the secondary combustion zone by energizing an ignitor in the secondary combustion zone.

26. The method of claim 25 further comprising maintaining the ignitor in an energized condition until the detected temperature is above the first determined temperature.

27. The method of claim 26 wherein the first and second determined temperatures are respectively above 1000° F. and 600° F.

28. The method of claim 25 further comprising (i) detecting if the fuel was ignited by the ignitor being energized a short time after energization of the ignitor and (ii) maintaining the ignitor in an energized condition until the detected temperature is above the first determined temperature in response to detecting step (i) detecting fuel ignition.

29. The method of claim 25 further comprising (i) detecting if the fuel was ignited by the ignitor being energized a short time after energization of the ignitor, (ii) maintaining the ignitor in an energized condition until the detected temperature is above the first determined temperature in response to detecting step (i) detecting fuel ignition, and (iii) stopping the supply of the fuel to the secondary chamber in response to detecting step (i) not detecting fuel ignition.

30. The method of claim 29 further comprising repeating steps (i), (ii) and (iii) subsequent to step (i) not detecting fuel ignition.

31. The method of claim 29 further comprising repeating steps (i), (ii) and (iii) only a predetermined number of times subsequent to step (i) not detecting fuel ignition.

32. The method of claim 25 wherein the first and second determined temperatures are respectively above 1000° F. and 600° F.

33. The method of claim 14 wherein the gaseous fuel flows into the secondary zone at a rate comparable to the flow rate of gas to a pilot burner of a natural gas furnace.

34. A wood stove adapted to be responsive to fuel from a gaseous hydrocarbon fuel source outside the stove, the stove comprising a combustion chamber having a primary combustion zone and a secondary combustion zone in direct fluid flow relation with each other, an inlet through a wall of the stove for admitting air from outside the stove into the primary combustion zone where wood is adapted to be loaded and burning, a conduit adapted to be connected to the fuel source for supplying gaseous fuel from the fuel source to the secondary combustion zone, a flow controller for the gaseous fuel in the conduit, means for detecting the presence and absence of ignition of the gaseous fuel flowing from the conduit into the secondary combustion zone, and means responsive to the detecting means for energizing the flow controller to on and off conditions, the combustion chamber being arranged so that gaseous hydrocarbon fuel in the secondary zone and wood in the chamber burn in said chamber, the gaseous hydrocarbon fuel being introduced into the secondary combustion zone in such a manner as to ignite unburned combustible gases leaving the wood being burned in the primary zone.

35. The wood stove of claim 34 further including a conduit for admitting air from outside the stove into the secondary combustion zone.

36. The wood stove of claim 34 further including an ignitor in the secondary zone positioned to selectively ignite the gaseous fuel flowing into the secondary zone from the conduit in response to the temperature detecting means.

37. The wood stove of claim 34 wherein the detecting means includes means for detecting the intensity of ultraviolet energy of the gaseous fuel flowing from the conduit into the secondary combustion zone.

38. The wood stove of claim 34 wherein the flow controller causes the gaseous fuel to flow into the secondary zone at a rate comparable to the flow rate of gas to a pilot burner of a natural gas furnace.

39. The wood stove of claim 34 wherein the primary and secondary zones are respectively at the bottom and top portions of the chamber.

* * * * *